US010570341B2

(12) United States Patent
Kinzl et al.

(10) Patent No.: US 10,570,341 B2
(45) Date of Patent: Feb. 25, 2020

(54) APPARATUS AND PROCESS FOR SEPARATING ASPHALTENES FROM AN OIL-CONTAINING FUEL

(71) Applicant: Siemens Aktiengesellschaft, Munich (DE)

(72) Inventors: Markus Kinzl, Dietzenbach (DE); Ansgar Kursawe, Niedernhausen (DE)

(73) Assignee: Siemens Aktiengesellschaft, Munich (DE)

( * ) Notice: Subject to any disclaimer, the term of this patent is extended or adjusted under 35 U.S.C. 154(b) by 2 days.

(21) Appl. No.: 15/567,804

(22) PCT Filed: Feb. 12, 2016

(86) PCT No.: PCT/EP2016/052955
§ 371 (c)(1),
(2) Date: Oct. 19, 2017

(87) PCT Pub. No.: WO2016/173732
PCT Pub. Date: Nov. 3, 2016

(65) Prior Publication Data

US 2018/0119026 A1 May 3, 2018

(30) Foreign Application Priority Data

Apr. 28, 2015 (DE) ..... 10 2015 207 764

(51) Int. Cl.
*C10G 21/00* (2006.01)

(52) U.S. Cl.
CPC ..... *C10G 21/003* (2013.01); *C10G 2300/206* (2013.01)

(58) Field of Classification Search
CPC ..... C10G 21/003; C10G 2300/206
See application file for complete search history.

(56) References Cited

U.S. PATENT DOCUMENTS

| | | | | |
|---|---|---|---|---|
| 2,729,589 | A | 1/1956 | Waghorne et al. | |
| 3,443,687 | A * | 5/1969 | Deussner | B07B 4/025 209/3 |
| 3,798,157 | A * | 3/1974 | Manzanilla et al. | C10G 21/003 208/251 H |
| 4,279,739 | A * | 7/1981 | Roach | C10C 3/08 208/309 |
| 4,515,685 | A | 5/1985 | Yeh | |
| 4,666,562 | A * | 5/1987 | Nelson | B01D 3/06 203/88 |
| 5,354,454 | A | 10/1994 | Savastano et al. | |
| 2007/0295644 | A1 | 12/2007 | Chirinos et al. | |
| 2013/0098735 | A1 | 4/2013 | Corscadden et al. | |
| 2014/0246357 | A1 | 9/2014 | Corscadden et al. | |
| 2016/0040079 | A1 | 2/2016 | Corscadden et al. | |

FOREIGN PATENT DOCUMENTS

| | | | |
|---|---|---|---|
| CA | 1229317 | A | 11/1987 |
| DE | 961480 | C | 4/1957 |
| GB | 1175028 | A | 12/1969 |
| GB | 2124250 | A | 2/1984 |
| JP | S4618385 | | 5/1971 |
| JP | S5927987 | A | 2/1984 |
| JP | 2014532110 | A | 12/2014 |

OTHER PUBLICATIONS

International Search Report dated May 17, 2016, for PCT/EP2016/052955.

* cited by examiner

*Primary Examiner* — Randy Boyer
(74) *Attorney, Agent, or Firm* — Beusse Wolter Sanks & Maire

(57) ABSTRACT

An apparatus for separation of asphaltenes from an oil-containing fuel, has a mixing element for intensive mixing of the oil-containing fuel with a solvent to form a solution supersaturated with asphaltenes, a vessel for reducing the oversaturation by depositing the asphaltenes out of the supersaturated solution, a growth zone formed within the vessel for growth of asphaltene particles present via the asphaltenes separated out of the supersaturated solution, and a classifying unit connected in terms of flow to the vessel for separation of the asphaltene particles grown in the growth zone in terms of their particle size, wherein the vessel is formed and set up such that a stream containing asphaltene particles circulates between the mixing element and the growth zone of the vessel. A corresponding process has a stream containing asphaltene particles that circulates between the mixing element and the growth zone of the vessel.

26 Claims, 2 Drawing Sheets

APPARATUS AND PROCESS FOR SEPARATING ASPHALTENES FROM AN OIL-CONTAINING FUEL

CROSS REFERENCE TO RELATED APPLICATIONS

This application is the US National Stage of International Application No. PCT/EP2016/052955 filed Feb. 12, 2016, and claims the benefit thereof. The International Application claims the benefit of German Application No. DE 102015207764.0 filed Apr. 28, 2015. All of the applications are incorporated by reference herein in their entirety.

FIELD OF INVENTION

The invention relates to an apparatus for the separation of asphaltenes from an oil-containing fuel. The invention further relates to a corresponding process for the separation of asphaltenes from an oil-containing fuel.

BACKGROUND OF INVENTION

In the area of energy production, oil-containing fuels such as crude and heavy oils, which are available as inexpensive fuels for energy production by gas turbines, are frequently relied on. However, such crude and heavy oils contain asphaltenes, which in turn contain chemically-bound heavy metals. In combustion of these oils, heavy metals such as vanadium or nickel are released as metal oxides. The metal oxides form alloys with the metals of the turbine blades and corrode or weaken them.

In addition, regardless of their metal content, asphaltenes have the property of being precipitated as a solid on sudden changes in pressure or temperature. These solid asphaltene particles can block lines or fine nozzles of the burner used and thus have a sustained effect on mixture formation in the turbine, reducing its efficiency.

Accordingly, an inhibitor is added to oils containing vanadium that prevents alloying of the metal oxides with the metal of the turbine blades. In the case of a magnesium additive that is commonly used as an inhibitor but is costly, a high-melting magnesium forms rather than low-melting alkali vanadates. In this case, however, there is a risk of crust formation on the turbine blades through layered precipitation of the magnesium vanadate. In order to ensure the functioning of the turbine and preserve aerodynamic quality/efficiency, the precipitates or crusts must be removed from the turbine blades, which requires regular time- and cost-intensive servicing. More particularly, such cleaning requires that the turbine be shut down for several hours.

For more sensitive turbines, for example those with gas-cooled blades, the problem of blockage of the burner nozzles by undesirable asphaltene precipitates or blockage of the cooling channel by vanadates has not yet been solved.

Moreover, so-called deasphalting processes are known that are based on extraction of asphaltenes with aliphatic hydrocarbons as precipitants. However, these processes for asphaltene reduction are used only in the area of refineries. Use in the area of power plants is not appropriate, because, for example, "classical" deasphalting by means of the so-called ROSE process involves asphaltene extraction with low-molecular aliphatics that require residence times of up to several hours. In the ROSE process in particular, such deasphalting involves high temperatures and pressure in the "critical" range of the solvents.

With respect to the typical requirements of power plants of oil inflow of 200 t/h and low operating costs, classical processes must also be dimensioned differently than in a refinery. On the one hand, low residence times are required to increase throughput, and on the other, in the case of typically observed single-cycle gas turbine power plants, there is enough "cost-free" waste heat available to allow operation of the process without external heating and the addition fuel costs associated therewith.

SUMMARY OF INVENTION

A first object of the invention is to provide an apparatus by means of which fuel-efficient and inexpensive asphaltene precipitation from an oil-containing fuel can be achieved.

A second object of the invention is to provide a process that allows correspondingly simple and inexpensive asphaltene precipitation.

The first object of the invention is solved according to the invention by an apparatus for the separation of asphaltenes from an oil-containing fuel comprising a mixing element for intensive mixing of the oil-containing fuel with a solvent to form a solution supersaturated with asphaltenes, a vessel for reducing the supersaturation by precipitating the asphaltenes from the supersaturated solution, a growth zone formed inside the vessel for growth of asphaltene particles present via the asphaltenes separated from the supersaturated solution, and a classifying device fluidically connected to the vessel for the separation of the asphaltene particles grown in the growth zone according to their particle size, wherein the vessel is designed and configured such that a stream containing asphaltene particles circulates between the mixing element and the growth zone of the vessel.

The invention has two basic problems to deal with that arise in the precipitation of asphaltenes from an oil-containing fuel. On the one hand, in adding precipitants or solvents, as is common in deasphalting, there is a risk of uncontrolled premature precipitation of asphaltene particles, as the solvents used in deasphalting and the respective oil-containing fuels are not fully miscible. The phase interface occurring despite the mixing promotes the spontaneous and uncontrolled precipitation of the asphaltenes. The particles produced in precipitation are usually ultra-fine particles, whose separation from the respective mother liquor, i.e. in the present case the oil-containing fuel, is virtually impossible.

This gives rise to the second problem. If the precipitated ultra-fine particles have growth nuclei or correspondingly large surfaces available, the particles will precipitate thereon. With respect to the apparatuses used for deasphalting, these surfaces are provided by the walls of the individual apparatus components or by the growth nuclei contained in the fuel, on which the asphaltene particles precipitate and grow. However, it is important to prevent this with respect to undesirable crusting and obstructions, so-called fouling, and the effects connected therewith on a gas turbine process connected downstream thereof.

Taking into account this problem, it is found according to the invention that precipitation and precipitation for subsequent separation of the asphaltene particles from the oil-containing fuel can more particularly be implemented in a controlled manner when rapid mixing is carried out in combination with the selective provision of growth nuclei.

For this purpose, the apparatus used for the separation comprises a mixing element for intensive mixing of the oil-containing fuel with a solvent to form a solution supersaturated with asphaltenes and a vessel for reducing the supersaturation by precipitating the asphaltenes from the supersaturated solution. A growth zone is configured inside the vessel, in which the asphaltene particles present grow via the asphaltenes separated from the supersaturated solution. In this case, the vessel is designed and configured such that a stream containing asphaltene particles circulates between the mixing element and the growth zone of the vessel.

By means of the circulation of the stream containing asphaltene particles between the growth zone and the mixing element, two effects are simultaneously achieved. On the one hand, the use of a mixing element that ensures rapid and intensive mixing of the oil-containing fuel to be cleaned with the solvent used for precipitation of the asphaltenes results in a metastable, supersaturated solution that inhibits the formation of a phase interface between the two components and thus prevents premature precipitation of asphaltene particles during the mixing process.

On the other hand, the circulation of the asphaltene particles ensures that at every site where the particles are formed and begin to precipitate, i.e. already after completion of the mixing process, growth nuclei coordinated with the separation process are available for precipitation and growth of the asphaltenes thereon. The particles formed in this manner do not precipitate as ultra-fine particles, but have the possibility of growing on an existing particle that is made available. Accordingly, the subsequent separation by means of the classifying device is also simplified.

Overall, the asphaltene particles present in the process are therefore selectively used as growth nuclei, which promote precipitation of asphaltenes and at the same time prevent precipitation-induced fouling of walls, pipelines, etc. of an apparatus correspondingly used for deasphalting.

In this case, the stream containing asphaltene particles circulates between the mixing element and the growth zone such that the volume elements containing the asphaltene particles pass multiple times through both the growth zone and the mixing element. In this manner, an increase in size of the already-existing particles occurs during precipitation of the asphaltenes instead of the formation of new ultra-fine particles. The particles accumulate inside the vessel and can then be separated from the oil-containing fuel according to their particle size by the classifying device connected to the vessel. A mixing pump having a high shear rate is advantageously used as a mixing element.

On completion of the mixing process, i.e. when a supersaturated solution of oil-containing fuel and solvents leaves the mixing zone or the mixing element, precipitation of the asphaltenes begins. Because of the asphaltene particles present due the circulation of the stream in the mixing zone or at the mixing site, the asphaltenes precipitating from the solution can be deposited on the particles and grow thereon. The supersaturation of solution can thus be reduced in a controlled manner due to the presence of the asphaltene particles in the stream. The growth of the asphaltene particles continues inside the vessel. Here, the particles can grow until they reach the particle size desired for separation. Separation of the particles takes place by means of the classifying device connected to the vessel.

The fuel to be cleaned of asphaltenes is more particularly a heavy oil, the main components of which are, in addition to the asphaltenes (highly-condensed aromatic hydrocarbons), primarily alkanes, alkenes, and cycloalkanes. Additional components are aliphatic and heterocyclic nitrogen and sulphur compounds.

Particularly suitable solvents are short-chain hydrocarbons such as butane (C4), pentane (C5), hexane (C6), and/or heptane (C7). In this case, the solvent is used to dissolve soluble components contained in the oil-containing fuel, such as aliphatics, for example. As the asphaltenes contained in the oil-containing fuel are insoluble in the solvent used, the solvent can in a sense be referred to with respect to the asphaltenes as an "anti-solvent".

Particularly advantageously, a supply line for the oil-containing fuel and/or a supply line for the solvent is/are connected to the mixing element. If both supply lines are connected to the mixing element, mixing of the two components takes place directly in the mixing element. Such an embodiment is particularly advantageous because it ensures rapid and favorable mixing.

Alternatively, it is also possible to bring the oil-containing fuel and solvent into contact prior to entry into the mixing element, which may necessary due to structural conditions, for example. The streams are then supplied together to the mixing element, and a supersaturated solution is produced therein by means of rapid mixing.

More particularly, the vessel itself is configured such that it allows a sufficiently long residence time for the growth of the asphaltene particles. In this manner, the solid enrichment in the vessel required for separation is ensured. Inside the vessel, the precipitated asphaltene particles continue to grow prior to their separation. In this case, the growth is influenced or limited by the equilibrium between the number of particles remaining in the vessel and the number of circulating particles. Here, the longer the residence time, the higher the precipitation rate as well, and thus the higher the cleaning efficiency of the apparatus used for separation due to the improved separation.

The growth zone of the vessel is understood to refer to the zone in which the asphaltene particles grow from the mixture, i.e. the supersaturated solution, by the precipitation of further asphaltenes. In this case, the growth zone can be limited to a volume inside the vessel. Alternatively, the entire vessel volume can be available as a growth zone for the asphaltene particles.

The particle growth and thus the separation of the asphaltenes from the liquid phase take place on the surface of the asphaltene particles. Although the particles have a high specific surface area, they are only poorly separable. A vessel with a growth zone in which a high mass of particles per volume is provided allows the growth of larger and more easily separable particles and also provides a high absolute surface area for a high precipitation efficiency.

The classifying device is connected to the vessel for separation of the asphaltene particles located therein, and more particularly in order to keep the particles required for growth inside the vessel. In this case, separation takes place according to particle size, wherein small and large asphaltene particles are separated from one another. For this purpose, the classifying device advantageously comprises a number of separation stages, each of which is supplied with a partial stream of particles. Here, the average diameter of the separated particles depends, for example, on the oil used, the predetermined separating grain size, and the growth rate of the asphaltene particles.

By means of the classification inside the classifying device or inside the separation stages, the desired enrichment of the asphaltene particles in the vessel can be achieved. The adaptation of the amount of solid present in the vessel that can be achieved by selective control of the two partial streams withdrawn from the vessel makes it possible to carry out the desired adaptation of the available surface to the process requirements.

The required volume of the vessel decreases due to the particle growth inside the vessel, the accompanying increasing enrichment with particles, and the available surface area.

The particles have a significantly longer residence and growth time inside the vessel than the liquid flowing through, which gives rise to large and readily separable particles. In other words, the solid enrichment inside the vessel makes it possible to predetermine difference residence times for the liquid and the solid. The requirements for the duration of growth of the solid particles and the short liquid residence time, which allows the use of a vessel of small size, can thus both be taken into consideration equally.

If the particle concentration increases during a long residence time inside the vessel, for example by a factor of 3, the area available for particle growth is also approximately 3 times larger. This causes the volume-specific precipitation efficiency (kg of asphaltene/h·$m^3$) of the vessel to increase by a factor of 3, so that the vessel volume can be reduced by a factor of 3 with the same precipitation efficiency compared to cases with no particle enrichment and a low residence time. In other words, particle enrichment inside the vessel or inside the corresponding growth zone allows the use of a vessel with smaller structural dimensions.

In general, small asphaltene particles are primarily understood to be those that have not yet grown sufficiently to be retained by a classifying device, i.e. cannot be kept in the process. For ultra-fine particles that are not classified, the hydrodynamic residence time is approximately 1 $\tau$.

The average diameter of the small asphaltene particles is typically less than 5 μm. Large asphaltene particles are understood to refer to the particles which, because of their sharply larger average diameter, can be easily separated by the classifying device and supplied for a further utilization as a solid. Advantageously, particles are separated as large asphaltene particles whose average diameter is greater than 25 μm.

The stream circulating between the mixing element and the growth zone of the vessel advantageously contains asphaltene particles of average size. More particularly, the circulating stream contains asphaltene particles with an average diameter in the range of 5 μm to 20 μm. The number of asphaltene particles circulating in the partial stream is determined by the residence time in the vessel—depending on the classification of the particles.

Of course, the particle sizes given for the small, medium and large asphaltene particles are not limited to the indicated ranges. Depending on the embodiment of the apparatus, the desired residence time inside the vessel or the growth zone, and the oil-containing fuel to be cleaned, the particle sizes may be different from the above-mentioned values or range.

The asphaltene particles of average size flow from the growth zone to the mixing element, where they are available as growth nuclei for the asphaltenes to be precipitated from the mixture. By means of the mixing element, the stream containing the solvent used and the oil-containing fuel to be cleaned is mixed. The asphaltenes contained in the mixture then precipitate on the asphaltene particles already present in the mixture as solid particles and continue to grow thereon.

In order to create the best possible growth conditions for the asphaltene particles and at the same time allow a flexible reaction to different oil-containing fuels, a two-stage classifying device, i.e. a classifying device with two separation stages, is advantageously used. By means of the separation stages, small and large asphaltenes are advantageously separated from one another and at the same time separated from the "mother liquor," i.e. the mixture of fuel and solvent.

The circulation of the stream containing asphaltene particles is achieved in an advantageous embodiment of the invention via a fluidic connection of the mixing element to the vessel. For this purpose, the vessel for circulation of the stream containing asphaltene particles is advantageously fluidically connected to the mixing element.

By means of this fluidic connection, the stream containing asphaltene particles is supplied from the vessel to the mixing element and mixed therein with the oil-containing fuel and solvent. The resulting mixed stream is supplied to the vessel, for which purpose the mixing element is advantageously fluidically connected to a supply line of the vessel via a discharge line.

The asphaltene particles contained in the mixed stream grow inside the vessel. The large asphaltene particles are separated. Small particles are discharged with the oil stream. The stream, which essentially contains asphaltene particles of medium size, is again supplied to the mixing element. In order to discharge the stream essentially containing asphaltene particles of medium size from the vessel, the vessel is advantageously fluidically connected to a supply line of the mixing element via a discharge line.

The stream supplied from the vessel to the mixing element is refreshed inside the mixing element with the freshly supplied oil-containing fuel and the solvent. In this case, the asphaltene particles contained in the stream serve as growth nuclei. They provide the surface required for growth of the asphaltene particles. In this process, a large portion of the mixture, i.e. the stream containing the asphaltene particles, is circulated multiple times.

The amounts of the respective circulated streams can be described by mass flow ratios. Mass flow is understood to be the mass of a medium that passes through a cross-section per unit time. In this case, the mass ratio advantageously considered is that of the stream containing the asphaltene particles to the mixed stream (total of the feed streams of the oil-containing fuel and the solvent). The ratio of the stream supplied from the vessel to the mixing element to the total of the feed streams, depending on the solid concentration contained therein, is advantageously in the range of 0.1:1 to 100:1.

In this context, with a high solid concentration, a low ratio of the mass flows can be set. A low mass flow ratio is more particularly desirable for cost reasons, as high circulation ratios require larger pumps and larger pipe diameters, resulting in pressure losses.

Here, a mass flow ratio in the range of 10:1 to 10:5 is advantageous. More particularly advantageous is a mass flow ratio of 10:1. A ratio of 10:1 means that the mass of the stream containing asphaltene particles, which flows in the direction of the mixing element, is approximately 10 times greater than the total of the feed streams of the oil-containing fuel and the solvent to the mixing element.

In an alternative embodiment of the invention, it is provided that the mixing element is arranged inside the vessel. In the arrangement of the mixing element inside the vessel, the oil-containing fuel and the solvent are metered via corresponding supply lines into the vessel, where they are immediately intensively mixed. For mixing, a mixing element is advantageously used that operates according to the rotor-stator principle and shows a high shear rate. In this case, it is also possible to use a mixing pump, the static portion of which is arranged, for example, on the wall of the vessel.

The mixing advantageously takes place in a so-called mixing zone or at a mixing site inside the vessel. The mixing zone is advantageously located close to the vessel wall so that the mixing takes place immediately after influx of the feed streams, i.e. the streams of the oil-containing fuel and the solvent, resulting in the formation of a supersaturated solution.

The mixture flows through a suitable flow control inside the vessel into the growth zone of the vessel, where the asphaltenes precipitate. Asphaltene particles already present in the vessel are also available to them in this case as growth nuclei. As is also the case in a structurally separate arrangement of the mixing element and the vessel, the stream containing asphaltene particles circulates between the growth zone of the vessel and the mixing element.

On the whole, the circulation of a stream containing asphaltene particles between the growth zone of the vessel and the mixing element—regardless of whether the mixing element is arranged as a separate component or inside the vessel—makes it possible to provide a large surface area required for the deasphalting of an oil-containing fuel for selective precipitation of the asphaltenes and simultaneous prevention of crust formation due to fouling.

The asphaltene particles grown inside the growth zone of the vessel are separated according to their particle size. The classifying device connected to the vessel allows selective enrichment of solid particles, which increases the precipitation rate and thus the purification efficiency of separation.

Particularly advantageous is the use of a classifying device comprising a plurality of separation stages in order to achieve the best possible separation efficiency. The term separation stage should be understood here as referring to structural components that allow selective separation of the asphaltene particles according to their particle size.

The respective separation stages used are advantageously configured as hydrocyclones. A hydrocyclone is a centrifugal separator for liquid mixtures. By means of a hydrocyclone, solid particles contained in suspensions can be separated or classified. The first partial stream discharged from the vessel and enriched with large asphaltene particles is directed by the hydrocyclone, thus separating the large asphaltene particles from the mother liquor.

The use of a hydrocyclone is advantageous in this case because it is composed of a vessel without moving parts and has a small volume based on the short residence time of the first partial stream. An alternative embodiment of the invention provides for the use of decanters and/or self-cleaning edge gap filters as separation stages, alternatively or additionally to the hydrocyclones.

The classifying device used for separation advantageously comprises a first separation stage for the separation of large asphaltene particles from a first partial stream. For supplying the first partial stream to the first separation stage, the vessel is advantageously fluidically connected to a supply line of the first separation stage via a first discharge line. The first discharge line of the vessel is advantageously arranged at the bottom thereof so that the first partial stream can be withdrawn at the bottom of the vessel and supplied to the first separation stage.

The separation inside the first separation stage is carried out taking into account a predetermined separating grain size. Asphaltene particles, the average diameter of which is larger than a predetermined separating grain size, are discharged and removed from the process. With a separating grain size of 25 μm, therefore, particles having an average diameter greater than 25 μm are discharged.

For recycling of a first return flow depleted of large asphaltene particles, the first separation stage is advantageously fluidically connected to a supply line of the vessel via a return line. In other words, by separation of the large asphaltene particles, a return flow is formed that comprises the asphaltene particles whose size is less than the predetermined separating grain size. This return flow is returned to the vessel, wherein the asphaltene particles still contained in the return flow serve as growth nuclei inside the vessel or inside the growth zone of the vessel.

Advantageously, a treatment device is fluidically installed downstream of the first separation stage. As a treatment device, for example, a centrifuge can be used by means of which the large asphaltene particles separated in the first separation stage can be finally separated, freed of adhering mother liquor, and removed from the separation process. The large asphaltene particles can then be supplied for a further use, such as, for example, for processing in road construction.

For the separation of small asphaltene particles from a second partial stream, the classifying device advantageously comprises a second separation stage. The vessel is advantageously fluidically connected to a supply line of the second separation stage via a second discharge line in order to supply the second partial stream to the second separation stage. The second discharge line of the vessel is advantageously arranged at the top thereof so that the second partial stream, starting from the top of the vessel, is supplied to the second separation stage.

The asphaltene particles discharged via the second discharge line of the vessel are separated from the solution inside the second separation stage. The small particles that have not yet grown to a sufficient extent for final separation are kept in the process. For this purpose, it is particularly advantageous if the second separation stage is connected to a supply line of the vessel for recycling of a second return flow enriched with small asphaltene particles via a return line. In this manner, the small asphaltene particles are returned to the vessel and can continue to grow therein.

Advantageously, the second separation stage is connected downstream of a treatment device in terms of flow dynamics. Separation of the small asphaltene particles from the second partial stream gives rise to a clear stream that is essentially free of asphaltene particles. Starting from the second separation stage, this clear stream is supplied to the treatment device as an outlet stream. The treatment device can be configured, for example, as a solvent preparation in which the solvent, or with respect to the asphaltenes, the so-called "anti-solvent," i.e. the short-chain alkane used, can be recovered by evaporation. The solvent regenerated in this manner can again be supplied to the process and be used again for deasphalting.

In a further embodiment, the vessel for classification of the asphaltene particles is configured according to their particle size. For this purpose, the vessel advantageously comprises a classifying zone, inside of which the asphaltene particles are separated according to their particle size. The classifying zone is thus integrated into the vessel and advantageously provided in the edge area of the vessel. More particularly, in the use of a vessel with an integrated classifying zone, it is possible to dispense with the first separation stage, as the classifying discharge of larger particles is already achieved by means of the design of the vessel and the flow control inside the vessel.

Of course, in addition to a vessel having an internal classifying function as described above, it is also possible to use an external separation stage, which allows further separation of the asphaltene particles.

Overall, it is possible to use such an apparatus on an industrial scale in the area of power plants, as the plant size and the investment and operating costs are sharply reduced compared to conventional apparatuses for deasphalting. This makes it possible to carry out deasphalting as an oil pretreatment, which allows the use of heavy fuel oil containing more than 100 ppm of vanadium for energy generation by class E gas turbines. Crude oil with vanadium concentrations much higher than 10 ppm, which was previously under strong economic pressure due to its high content of magnesium inhibitors and the enormous service expense connected therewith, can also be used in class E gas turbines.

Furthermore, light crude oils such as, for example, Arabian extra light crude containing 1 ppm of vanadium or Arabian light crude containing >10 ppm of vanadium can also be used in highly efficient, but also sensitive class F and H gas turbines. Such use was previously sharply limited by the considerable asphaltene concentrations, and in the case of vanadium concentrations of greater than 0.5 ppm, was even completely impossible.

The second object of the invention is achieved according to the invention by processes for the separation of asphaltenes from an oil-containing fuel, wherein the oil-containing fuel is intensively mixed with a solvent by means of a mixing element, wherein a solution supersaturated with asphaltenes is formed during the mixing process, wherein the supersaturation is decreased by precipitating the asphaltenes from the supersaturated solution in a vessel, wherein asphaltene particles present in a growth zone of the vessel grow via asphaltenes precipitated from the supersaturated solution, wherein the asphaltene particles grown in the growth zone are separated by means of a classifying device according to their particle size, and wherein a stream containing asphaltene particles circulates between the growth zone of the vessel and the mixing element.

Because of the circulation of the stream containing asphaltene particles, asphaltene particles that serve as growth nuclei are already available on mixing of the oil-containing fuel to be cleaned with the solvent. In this case, already present asphaltene particles can grow without the need for formation of new ultra-fine particles. The formation of such ultra-fine particles takes place only once at the beginning of the process, i.e. when the plant is started up. In the further process, these ultra-fine particles then serve as growth nuclei in the process and make it possible to reduce supersaturation due to precipitation of asphaltene particles from the supersaturated solution.

Accordingly, a major portion of the mixture, i.e. the stream containing the asphaltene particles, is circulated. Moreover, the selective enrichment of solid particles, i.e. the asphaltene particles to be separated, is used to increase the precipitation rate and thus improve cleaning efficiency.

In a particularly advantageous embodiment, the stream containing asphaltene particles flows from the vessel into the mixing element. In this case, the particles required for the precipitation of asphaltenes are provided. The stream containing asphaltene particles is advantageously mixed in the mixing element with the oil-containing fuel and the solvent.

The mixing gives rise to a supersaturated solution from which the asphaltenes are precipitated and deposited on the surface of the asphaltene particles acting as growth nuclei. Advantageously, the mixture of the stream containing the asphaltene particles, the oil-containing fuel, and the solvent is supplied to the vessel. The asphaltene particles continue to grow inside the vessel.

In an alternative embodiment, the oil-containing fuel and the solvent are mixed inside the vessel. In this case, the mixing element is advantageously arranged inside the vessel. The oil-containing fuel and the solvent are directly metered into the vessel and mixed at the inlet site. The inlet site is therefore advantageously configured as a mixing site or a mixing zone. Mixing advantageously takes placed by means of a mixing element with a high shear rate operating according to the rotor-stator principle.

Advantageously, a first partial stream for the separation of large asphaltene particles is supplied to a first separation stage of the classifying device. The first partial stream is advantageously withdrawn from the vessel at the bottom thereof and flows from there into the first separation stage. In the first separation stage, the large asphaltene particles that exceed a predetermined separating grain size are separated and thus removed from the process.

It is particularly advantageous if a first return flow depleted of large asphaltene particles is supplied to the vessel. The return flow contains asphaltene particles that are smaller than the separating grain size of the first separation stage. The particles again serve as growth nuclei inside the vessel and improve the solid enrichment inside the vessel.

The large asphaltene particles separated form the first partial stream are advantageously supplied to a treatment device. For example, the treatment device can be configured as a centrifuge by means of which the large particles are separated. A possible use of the separated asphaltene particles is in road construction.

Moreover, it is advantageous if a second partial stream for the separation of small asphaltene particles is supplied to a second separation stage of the classifying device. The second partial stream is advantageously withdrawn from the top of the vessel and supplied to the second separation stage.

Virtually no small asphaltene particles are separated inside the second separation stage, wherein a return flow enriched with small asphaltene particles arises. The second return flow enriched with small asphaltene particles is advantageously supplied to the vessel. The small particles can thus continue to grow inside the vessel.

The outlet stream depleted of small asphaltene particles, i.e. the clear stream, is advantageously supplied to a treatment device. In this case, the outlet stream should advantageously be supplied to a solvent recovery unit in which the solvent is evaporated and regenerated. Finally, a solvent regenerated in this manner, for example a pentane fraction, can again be used for mixing with the oil-containing fuel.

In a further advantageous embodiment of the invention, the asphaltene particles are separated according to the particle size inside a classifying zone of the vessel. In other words, the vessel functions as a classifier in which the particles are pre-separated according to their particle size. This is therefore an internal classifying zone inside the vessel which is advantageously provided in the edge area of the vessel in the form of a rest zone.

In this case, the advantages mentioned with respect to preferred embodiments of the apparatus can be transferred by analogy to corresponding embodiments of the process.

BRIEF DESCRIPTION OF THE DRAWINGS

In the following, examples of the invention will be explained in further detail with reference to a drawing. The figures are as follows.

DETAILED DESCRIPTION OF INVENTION

Figure 1:
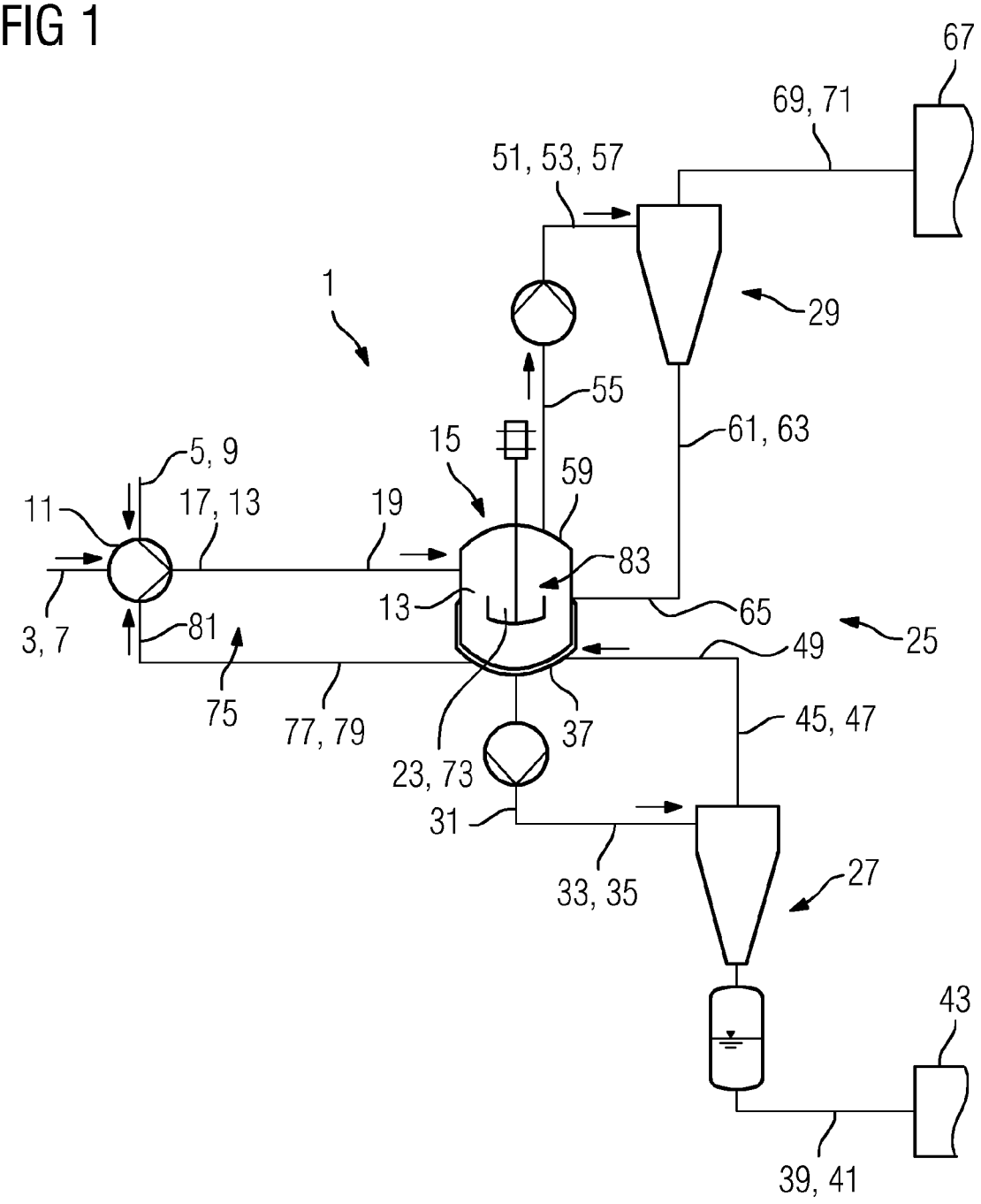
FIG. 1 shows an apparatus for the separation of asphaltenes from an oil-containing fuel with a container fluidically connected to a mixing element.

FIG. 1 shows an apparatus 1 for the separation of asphaltenes from an oil-containing fuel 3. A heavy oil is used as a fuel 3. Together with pentane as a solvent 5, the heavy oil 3 is supplied via corresponding supply lines 7, 9 to a mixing element 11 configured as a mixing pump. Inside the mixing element 11, the heavy oil 3 and the solvent 5 are subjected to ultra-rapid mixing.

Rapid mixing gives rise to a metastable, supersaturated solution, thus avoiding the formation of a phase interface between the heavy oil 3 and the pentane 5 and preventing premature precipitation of asphaltene particles during the mixing process.

The resulting mixture 13 is supplied to a vessel 15 fluidically connected to the mixing element 11, for which purpose the mixing element 11 is fluidically connected via a discharge line 17 to a supply line 19 of the vessel 15. The precipitation process of the asphaltenes already begins on supply to the vessel 15, i.e. after completion of the mixing process. The asphaltenes precipitating from the solution are deposited on asphaltene particles already present in the process.

Inside the vessel 15 is a growth zone 23 in which the asphaltene particles grow. The solid enrichment inside the vessel 15 required for the separation following this growth is ensured by means of a sufficiently long residence time of the asphaltene particles in the vessel 15. The longer the residence time of the asphaltene particles, the higher the precipitation rate, and thus, because of the improved separation of the particles, the higher the cleaning efficiency of the separating apparatus 1 used as well.

The vessel 15 is fluidically connected to a classifying device 25 for separation of the asphaltene particles that have grown in the growth zone 23 according to their particle size.

For this purpose, the classifying device 25 comprises two separation stages 27, 29. The coupling of the first separation stage 27 to the vessel is carried out via the connection of a first discharge line 31 of the vessel 15 to a supply line 33 of the first separation stage 27. Via the lines 31, 33, a first partial stream 35 is supplied to the first separation stage 27. The discharge line 31 of the vessel 15 is attached to the bottom 37 thereof.

In the first separation stage 27, which is configured as a hydrocyclone, large asphaltene particles 39 that exceed a predetermined separating grain size of 25 μm are removed from the process. They are supplied via a discharge line 41 to a treatment device 43 and can then be supplied for a further use, for example in road construction.

The separation of the large asphaltene particles 39 gives rise to a solution which is recycled to the vessel 15 as a first return flow 45. The first return flow 45 now contains only asphaltene particles having an average diameter of less than 25 μm. For recycling of the return flow 45, i.e. the partial stream depleted of large asphaltene particles, the first separation stage 27 is connected to a return line 47 that is in turn fluidically connected to a supply line 49 of the vessel 15. The asphaltene particles still contained in the return flow 45 serve as growth nuclei inside the vessel 15 or inside the growth zone 23 of the vessel.

The second separation stage 29 of the classifying device 25 is used for the separation of small asphaltene particles 51 from a second partial stream 53. For the supply of the second partial stream 53 to the second separation stage 29, the vessel 15 is fluidically connected via a second discharge line 55 to a supply line 57 of the second separation stage 29. The second discharge line 55 of the vessel is arranged at the top 59 thereof.

The second partial stream 53 essentially comprises small asphaltene particles 51 that are to be kept in the process so that they can continue to grow during the process. Accordingly, in the second separation stage 29, which is also configured as a hydrocyclone, asphaltene particles 51 with an average diameter of greater than 5 μm are separated from the liquid and returned to the vessel 15. Recycling of the second return flow 61 enriched with small asphaltene particles 51 takes place via a connection of a return line 63 of the second separation stage 29 to a supply line 65 of the vessel 15.

Furthermore, a treatment device 67 is also fluidically connected to the second separation stage 29. The outlet stream 71 generated on separation of the asphaltene particles 51, i.e. a clear stream, is supplied to the treatment device 67 via a discharge line 69 connected to the second separation stage 29. Inside the treatment device 67, the solvent 5 can be recovered and again supplied to the mixing element 11.

Asphaltene particles 73 with an average diameter in the range of 5 μm to 25 μm that can be moved in a circuit 75 are present inside the vessel 15 during the process. A partial stream 79 with these asphaltene particles 73 is supplied to the mixing element 11 via a return line 77 connected to the container 15.

For this purpose, the return line 77 of the vessel 15 is connected to a supply line 81 of the mixing element 11. Thus, in addition to the supply line 7 for the heavy oil 3 and the supply line 9 for pentane 5, the supply line 81 is also connected to the mixing element 11, with the line ensuring the supply or the circulation of growth nuclei for the asphaltene precipitation.

Because of the asphaltene particles 73 contained in the circulating partial stream 79, growth nuclei for the asphaltenes are already available at the time of mixing of the oil-containing fuel 3 and the solvent 5. The asphaltenes contained in the supersaturated solution, i.e. the mixture 13, precipitate only on the asphaltene particles 73 already present and grow thereon. In other words, the precipitation, which essentially takes place after mixing of the oil-containing fuel 3 and the solvent 5, is selectively controlled by the circulation of the asphaltene particles between the mixing element 11 and the growth zone 23 of the vessel 15.

Inside the vessel 15, moreover, a classifying zone 83 can be configured which, alternatively or additionally to the first separation stage 27, separates large asphaltene particles. The position of the classifying zone 83 inside the vessel 15 is in this case indicated by an arrow.

Figure 2:
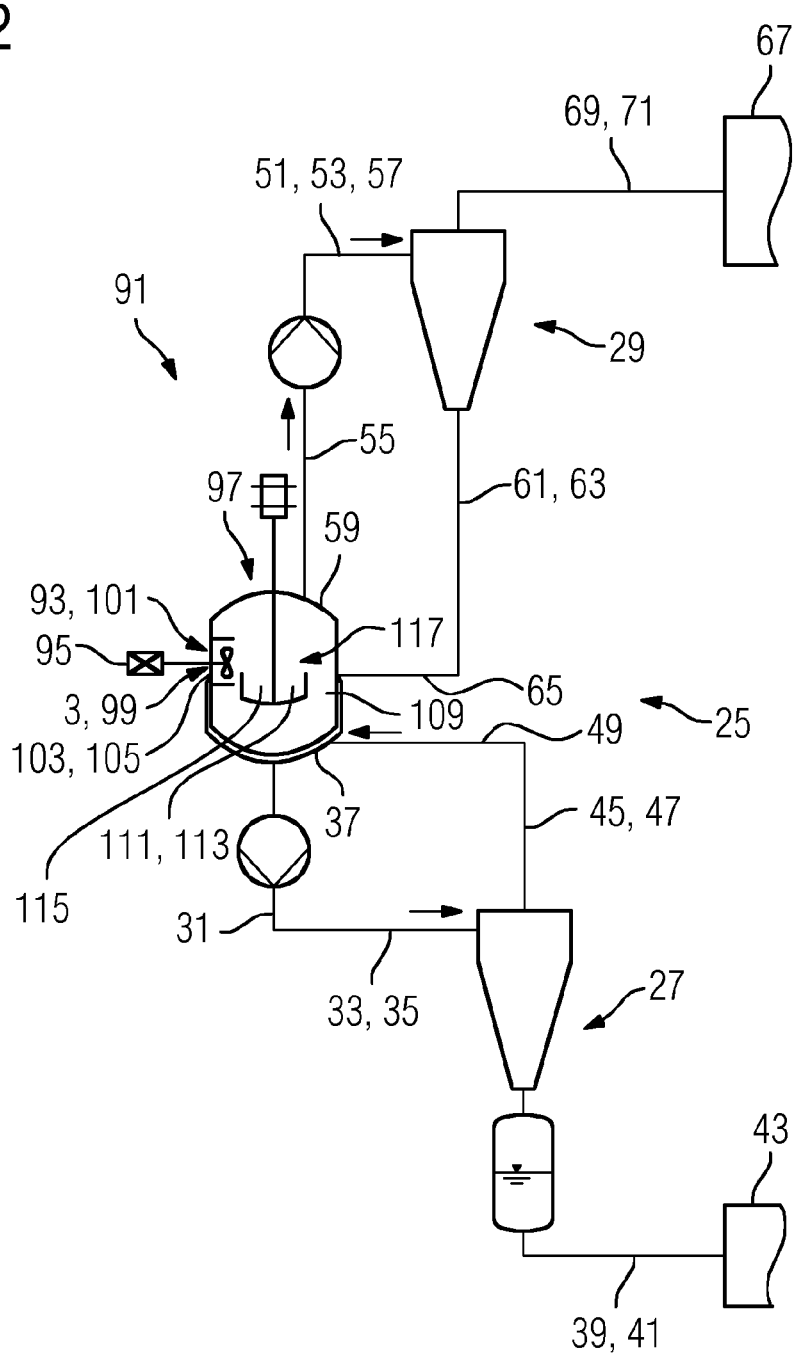
FIG. 2 shows a further apparatus for the separation of asphaltenes from an oil-containing fuel with a mixing element arranged inside a vessel.

FIG. 2 shows a further apparatus 91 that also serves to separate asphaltenes from an oil-containing fuel 3 using a solvent 93, in this case hexane.

The structural difference between the apparatus 91 and the apparatus 1 according to FIG. 1 lies in the fact that the mixing element 95 used is not installed upstream of the vessel 97, as is the case in apparatus 1, but instead is arranged inside the vessel 97.

In the arrangement of the mixing element 95 inside the vessel 97, the heavy oil 3 and the solvent 93, or the "anti-solvent" with respect to the asphaltenes contained in the oil-containing fuel 3, are metered via supply lines 99, 101 directly into the vessel 97. The mixing takes place inside the vessel 97 in a mixing zone 105 configured on the wall 103 of the vessel by means of the mixing element 95 configured as an internal mixing pump immediately on entry of the heavy oil 3 and the solvent 93. The mixing element 95 ensures the necessary ultra-rapid mixing of the two components 3, 93.

The mixture 109 resulting from mixing flows through a suitable flow control inside the vessel 95 into the growth zone 111 of the vessel 95, where the asphaltenes precipitate or the already precipitated asphaltene particles continue to grow. In this case as well, asphaltene particles 113 of average size already present in the vessel 95 are available to them as growth nuclei.

Because of the flow control, a partial stream 115 containing asphaltene particles 113 also circulates between the element 95 and the growth zone 111. As growth nuclei, the asphaltene particles 113 provide a surface that promotes the precipitation of asphaltenes and at the same time prevents deposition-related fouling of walls, pipelines or the like of an apparatus 1 used correspondingly for deasphalting.

As in FIG. 1 as well, the vessel 97 can be configured with a classifying zone 117, the position of which is indicated by an arrow, which alternatively or additionally serves as the separation stage 27 for the classification of large asphaltene particles.

With respect to the function of the further apparatus components comprised by the apparatus 91, the detailed description of the apparatus 1 according to FIG. 1 can be applied to the apparatus 91 according to FIG. 2.

The invention claimed is:

1. An apparatus for the separation of asphaltenes from an oil-containing fuel, comprising:

a mixing element for intensive mixing of the oil-containing fuel with a solvent to form a solution supersaturated with asphaltenes, a vessel for reducing the supersaturation by precipitating the asphaltenes from the supersaturated solution, a growth zone formed inside the vessel for growth of asphaltene particles present via the asphaltenes separated from the supersaturated solution, and a classifying device fluidically connected to the vessel for separation of the asphaltene particles grown in the growth zone according to their particle size, wherein the classifying device comprises a first separation stage for separating large asphaltene particles from a first partial stream, and wherein the classifying device comprises a second separation stage for separating small asphaltene particles from a second partial stream, wherein the vessel is designed and configured such that a stream containing asphaltene particles circulates between the mixing element and the growth zone of the vessel.

2. The apparatus as claimed in claim 1, wherein the vessel for circulation of the stream containing asphaltene particles is fluidically connected to the mixing element.

3. The apparatus as claimed in claim 1, wherein the mixing element is fluidically connected to a supply line of the vessel via a discharge line.

4. The apparatus as claimed in claim 1, wherein the vessel is fluidically connected to a supply line of the mixing element via a return line.

5. The apparatus as claimed in claim 1, wherein the mixing element is arranged inside the vessel.

6. The apparatus as claimed in claim 1, wherein the vessel is fluidically connected to a supply line of the first separation stage via a first discharge line in order to supply the first partial stream to the first separation stage.

7. The apparatus as claimed in claim 1, wherein the first separation stage is fluidically connected to a supply line of the vessel via a return line in order to recycle a first return flow enriched with asphaltene particles remaining after the large asphaltene particles are separated.

8. The apparatus as claimed in claim 1, wherein the first separation stage is fluidically connected upstream of a treatment device.

9. The apparatus as claimed in claim 1, wherein the vessel is fluidically connected to a supply line of the second separation stage via a second discharge line in order to supply the second partial stream to the second separation stage.

10. The apparatus as claimed in claim 9, wherein the second discharge line of the vessel is arranged at the top thereof.

11. The apparatus as claimed in claim 1, wherein the second separation stage is connected to a supply line of the vessel via a return line in order to recycle a second return flow enriched with the small asphaltene particles.

12. The apparatus as claimed in claim 1, wherein the second separation stage is fluidically connected downstream of a treatment device.

13. The apparatus as claimed in claim 1, wherein the vessel comprises a classifying zone for the separation of the asphaltene particles according to their particle size.

14. A process for the separation of asphaltenes from an oil-containing fuel, comprising:

mixing the oil-containing fuel intensively with a solvent by a mixing element, wherein a solution supersaturated with asphaltenes is formed during the mixing process, wherein the supersaturation is decreased by precipitating the asphaltenes from the supersaturated solution in a vessel, wherein asphaltene particles present in a growth zone of the vessel grow via asphaltenes precipitated from the supersaturated solution, separating the asphaltene particles grown in the growth zone by a classifying device according to their particle size, wherein a first partial stream is supplied to a first separation stage of the classifying device in order to separate large asphaltene particles, and wherein a second partial stream is supplied to a second separation stage of the classifying device for the separation of small asphaltene particles, and wherein a stream containing asphaltene particles circulates between the growth zone of the vessel and the mixing element.

15. The process as claimed in claim 14, wherein the stream containing asphaltene particles flows from the vessel into the mixing element.

16. The process as claimed in claim 14, wherein the stream containing asphaltene particles is mixed in the mixing element with the oil-containing fuel and the solvent.

17. The process as claimed in claim 16, wherein a stream containing the asphaltene particles, the oil-containing fuel, and the solvent is supplied to the vessel.

18. The process as claimed in claim 14, wherein the oil-containing fuel and the solvent are mixed inside the vessel.

19. The process as claimed in claim 14, wherein the first partial stream is withdrawn from the vessel at the bottom thereof.

20. The process as claimed in claim 14, wherein a first return flow enriched with asphaltene particles remaining after the large asphaltene particles are separated is supplied to the vessel.

21. The process as claimed in claim 14,
wherein the large asphaltene particles separated from the first partial stream are supplied to a treatment device.

22. The process as claimed in claim 14,
wherein the second partial stream is withdrawn from the vessel at the top thereof.

23. The process as claimed in claim 14,
wherein a second return flow enriched with the small asphaltene particles is supplied to the vessel.

24. The process as claimed in claim 14,
wherein an outlet stream depleted of small asphaltene particles is supplied to a treatment device.

25. The process as claimed in claim 14,
wherein the asphaltene particles are separated according to their particle size inside a classifying zone of the vessel.

26. The apparatus as claimed in claim 8, wherein the large asphaltene particles separated from the first partial stream are supplied to the treatment device.

* * * * *